US006253679B1

(12) United States Patent
Woodall et al.

(10) Patent No.: US 6,253,679 B1
(45) Date of Patent: Jul. 3, 2001

(54) MAGNETO-INDUCTIVE ON-COMMAND FUZE AND FIRING DEVICE

(75) Inventors: Robert Woodall, Lynn Haven; Felipe Garcia, Panama City; John Sojdehei, Panama City Beach, all of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/228,074

(22) Filed: Jan. 5, 1999

(51) Int. Cl.[7] ..... F42C 13/00; F42C 13/08

(52) U.S. Cl. ..... 102/221; 102/221; 102/206; 102/212; 102/215

(58) Field of Search ..... 102/221, 212, 102/215, 206, 427

(56) References Cited

U.S. PATENT DOCUMENTS 4,044,680 * 8/1977 Ziemba ..... 102/221
4,059,052 * 11/1977 Karr ..... 102/70.2
4,160,417 * 7/1979 Fowler ..... 102/221
4,203,366 * 5/1980 Wilkes ..... 102/214
4,205,316 * 5/1980 Peperone ..... 102/214
4,214,240 * 7/1980 Weiss ..... 343/7
4,220,093 * 9/1980 Nilsson ..... 102/212
4,458,248 * 7/1984 Lyasko ..... 343/719
4,686,885 * 8/1987 Bai ..... 89/6.5
5,027,709 * 7/1991 Slagle ..... 102/427
5,359,934 * 11/1994 Ivanov et al. ..... 102/214
5,751,239 * 5/1998 Wichmann ..... 342/68

* cited by examiner

*Primary Examiner*—Charles T. Jordan
*Assistant Examiner*—Lulit Semunegus
(74) *Attorney, Agent, or Firm*—Harvey A. Gilbert; Donald G. Peck

(57) ABSTRACT

A fuze is enabled, armed, and fired while indicating its status to remote command/receiver stations so that interconnected line charges and other ordnance items can be detonated with increased safety and reliability from a safe man-weapon separation distance. The fuze is responsive to remotely transmitted magneto-inductive command signals in the extremely low frequency (ELF) to very low frequency (VLF) range to change its status and to transmit magneto-inductive status signals in the ELF to VLF range confirming its status to at least one of the remote stations. Transmission and reception of magneto-inductive signals in the ELF to VLF range allow for a unique communication method that provides safe and reliable communication suitable to effect fuzing of explosive devices on the beach through seawater, air, earth, buildings, vegetation and sediment or any combination of these conditions.

15 Claims, 4 Drawing Sheets

MAGNETO-INDUCTIVE ON-COMMAND FUZE AND FIRING DEVICE

CROSS REFERENCE TO RELATED APPLICATIONS

This is a continuation in part of copending U.S. patent applications entitled "Reliable and Effective Line Charge System" by Felipe Garcia et al., U.S. Patent and Trademark Office Ser. No. 09/012932 (NC 78,433), filed Jan. 24, 1998, "Line Charge Insensitive Munition Warhead" by Felipe Garcia et al., U.S. Patent and Trademark Office Ser. No. 08/944049 (NC 78,448), filed Sep. 12, 1997, "Line Charge Connector" by Felipe Garcia et al., U.S. Patent and Trademark Office Ser. No. 09/030518 (NC 78,635), filed Feb. 23, 1998, "Magneto-Inductively Controlled Limpet" by John Sojdehei et al., U.S. Patent and Trademark Office Ser. No. 09/040184 (NC 78,836), filed Feb. 17, 1998, and "Magneto-Inductive Seismic Fence" by Robert Woodall et al., U.S. Patent and Trademark Office Ser. No. 09/030517 (NC 78,866), filed Feb. 23, 1998, and incorporates all references and information thereof by reference herein.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to fuzes for use with line charges and other ordnance items. In particular, this invention relates to fuzes that will enable, arm, and fire on command using magneto-inductive signals that are propagated at extremely low frequencies (ELF) to very low frequencies (VLF).

Using explosive weapon systems for a wide variety of commercial and military purposes usually requires considerable logistics and planning efforts to get the job done safely and effectively. Devices are required that will reduce the weight and space allocated to fuzing in ordnance and provide a safe and reliable arm-and-fire capability on-command. This requirement becomes especially important where assault or breaching operations occur in the littoral regions of the world. In other words, better fuzes and similar devices are needed for line charge systems and other weapon systems that are intended to be deployed in support of military and civilian operations.

For example, one effective line charge is the Shallow Water Assault Breaching System (SABRE), EX9 MODO. SABRE is launched via rocket. Only after the line charge is picked up does the fuzing become airborne and begin to become functional. SABRE requires a fuze that is able to function safely and reliably in accordance with established design criteria and under all operational conditions; however, the designed capabilities of the current SABRE fuze are compromised. This is because the rocket does not throw the line charge very far from the launch craft, and it is the fuze which provides for enabling, arming, and firing of the SABRE line charge. Because the line charge is very long (350 feet) and because SABRE will be used under circumstances for which warheads will not be under water, the fuze is prone to failing to meet crucial safety requirements.

One of these crucial safety requirements is set by MIL-STD-1316 and reads "no fuze shall arm prior to reaching safe separation." Safe separation is defined as the distance from the launch craft at which detonation of the ordnance will not result in unacceptable damage to the host craft or unacceptable injury to its occupants. The sensing of this safe separation distance is not a trivial concern. Fuzing that relies on a time delay element alone or in combination with a water sensor to delay arming (pyrotechnic, electronic, or mechanical), does not sense distance. Such fuzing does not limit the potential for the catastrophic consequences which are associated with deployment of an explosive line charge. The line charge may enable the current fuze (committing it to fire) while a section of the high explosive line charge remains out of the water or too close to the host platform. The probability of such a disastrous event must not exceed one instance out of one million munition deployments, without violating the requirement imposed by MIL-STD-1316 for safe separation.

Some fuzes for explosive line charges and similar explosive weapon systems use lanyards. At launch and subsequent fuze lift off of a line charge, a lanyard, tethered to the fuze, begins to pay out. The length of the lanyard is measured to ensure a safe separation distance. When the fuze flies far enough to pay out the measured length, the lanyard pulls tautly and exerts a tensile force on the fuze. This tensile force moves fuze explosive components to an in-line position to arm the fuze. The arming force also activates delay elements (pyrotechnic, electronic, or mechanical) that delay fuze detonation or arming until the ordnance has traveled to its predicted destination.

Unfortunately, fuzes employing lanyards are inherently unreliable at sensing a safe separation distance so that the fuze may be armed before the safe separation distance actually has been reached. Lanyards can snag, knot, fray and become entangled to shorten their apparent length to cause premature function, arming, or firing before the desired separation distance is reached. Also, lanyards can entangle items on the host craft to result in catastrophic failure when the entangled ordnance is detonated. Lanyards also increase the possibility of damage to the ordnance or launch craft by entraining a foreign object also known as FOD damage.

Lock-out timers have been added to lanyard systems. The lock-out timers usually pin the arming mechanism in place until a set time has elapsed after launch. This precludes sensing any premature arming force prior to the opening of the arming window. However, the problem with this arrangement is that it trades safety for reliability and it uses time as an indication of man-weapon separation distance rather than a direct measurement or discriminator.

RF commanded fuzes, water sensing fuzes, or acoustic fuzes have been used but each has inherent limitations especially when they are used to fuze a 350 foot long warhead. When launched into a mine/obstacle laden field during an amphibious assault, fuzes that sense water have limited operational viability since they may lodge atop an obstacle out of the water and dud. On the other hand, RF commanded fuzes are reliable on top of the beach or hanging in the air. But, if the RF fuzes are under water, earth, sand or vegetation, the RF command signals may not penetrate to the fuzes and the interconnected line charges will be duds. This limitation is partially corrected by using floating antennas for the RF commanded fuzes to have any chance of working in marine environments. However, floating antennas are inherently unreliable because they are prone to breakage, entanglement, or sinking. In addition, they are susceptible to electromagnetic pulse and exploitation by electronic warfare countermeasures. In general, RF commanded fuzes have very limited usefulness in the very hostile and RF saturated environment during amphibious assault operations.

Acoustic fuzes also are limited because they cannot effectively be communicated to in the air or, for that matter, when they are in the water due to the deleterious effects of sediments, microorganisms, algae, changes in salinity, multipaths, thermoclines, and biotic-induced noise and interference. Acoustic fuzes are unreliable at detecting signals in the littoral regions near amphibious assaults when noise is radiated through the water from ambient ships, mammals, munitions, landing craft, sonar, and crashing surf.

Thus, in accordance with this inventive concept, a need has been recognized in the state of the art for fuzes that eliminate the aforestated problems of the prior art by having unidirectional or bidirectional communications using magneto-inductive transmitters and receivers operating in the ELF to VLF range to assure safe and reliable commands and confirmations to effect on-command arming and subsequent detonation from a safe man-weapon separation distance of weapons emplaced in the littoral battle space. In addition, this fuze may be used (communicated to) one-way and still provide for safe and reliable functioning for a number of military and civilian items.

SUMMARY OF THE INVENTION

The invention is directed to providing a fuze system for ordnance capable of remotely transmitting magneto-inductive command signals in the ELF to VLF range to change the status of a fuze and to transmit magneto-inductive status signals in the ELF to VLF range confirming the changed status to at least one remote station.

An object of the invention is to provide a wireless fuze that can be safely and reliably command armed and command fired by remote signals.

Another object of the invention is to provide a fuze allowing reliable communication of commands and confirmations to and from the fuze using ELF to VLF communications.

Another object of the invention is to provide a safe and reliable fuze receiving command signals and transmitting status signals in the ELF to VLF range through sea, air, beach expanses, earth, or buildings, vegetation, and sediment or combinations of these conditions.

Another object of the invention is to provide a fuze placed in water, mud, sand, earth, air, vegetation, and/or debris that receives command signals from and transmits status signals to remote stations without needing a floating antenna.

An object of the invention is to provide a fuze communicating with remote stations when it is placed in multi-conductive paths, such as air/seawater interfaces, in the presence of very high acoustic ambient noise.

Another object is to provide a fuze capable of confirming its fuzing status to remote stations in the area of operations.

Another object of the invention is to provide a fuze having its status changed by coded transmissions from a remote transmitter and confirming the changed status to remote stations by coded transmissions.

Another object of the invention is to provide a fuze actuated by remotely originating magneto-inductive command signals in the ELF to VLF range and confirming such actuation via magneto-inductive status signals in the ELF to VLF range.

Another object is to provide a fuze capable of safe and reliable operation in all sea states, tides and surf conditions, regardless of salinity, thermal anomalies, man-made activities, multipaths, and clarity and under all weather conditions day and night.

An object of the invention is to provide a fuze that can be (A) scaled up to include additional bits/tones to cover more complex fuze functions or priority tasks or (b) scaled down in a likewise manner by using fewer bits/tones and/or the lack of a carrier frequency to effect less critical firing device practices.

These and other objects of the invention will become more readily apparent from the ensuing specification when taken in conjunction with the appended claims.

DESCRIPTION OF THE PREFERRED EMBODIMENT

Figure 1:
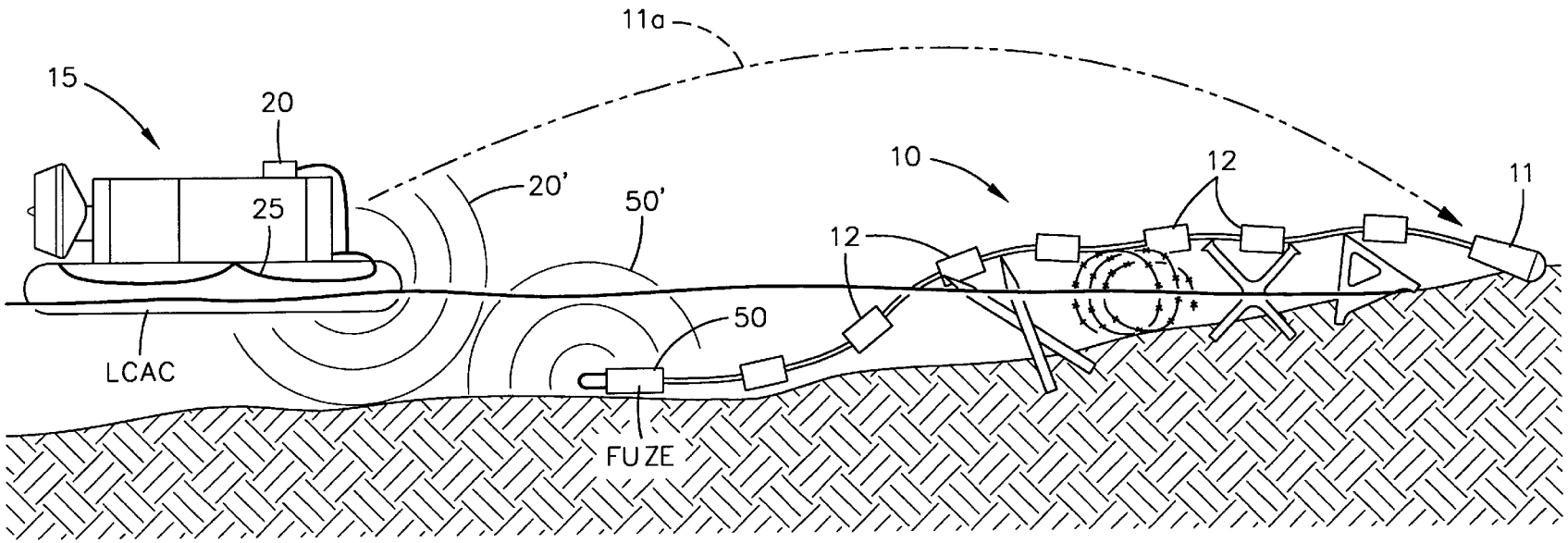
FIG. 1 shows a fuze in accordance with this invention operationally deployed with a line charge from a landing craft air cushion (LCAC) to breach obstacles at the shoreline.

Referring to FIG. 1 of the drawings, line charge 10 is shown just after it has been deployed from a landing craft, such as a landing craft air cushion (LCAC) 15. Rocket motor 11 pulls line charge 10 over a predetermined trajectory 11*a* so that it rests across a designated expanse of the beach that is laden with obstacles that may include mines.

Fuze 50 is attached to line charge 10 and, after deployment, may be located in or above the water and associated debris usually found near the shoreline. However, in accordance with this invention, wherever fuze 50 is placed, it performs the needed commands to reliably and safely turn-on, turn off, arm, disarm, fire, self-sterilize, and request-status-of fuze 50, and to indicate its status that these commands have, in fact, been performed. In further accordance with this invention, fuze 50 executes these commands in response to remotely transmitted magneto-inductive command signals 20' that are propagated in the range extending from extremely low frequencies (ELF) to very low frequencies (VLF). Fuze 50 then confirms its status that the commands have been executed to one or more remote stations, including LCAC 15 via magneto-inductive status signals 50' in the ELF to VLF range.

Thus, safe and reliable control is assured in high acoustic noise backgrounds, such as those encountered during most combat or assault operations. The use of magneto-inductive command and status signals in the ELF to VLF range assures safe and reliable communications with fuze 50, and confirms its status across a safe separation distance from LCAC 15. These communications are made through the sea, air, beach, buildings, vegetation and sediment or combinations of these conditions.

Line charge 10 has several spaced-apart, explosive charges or warheads 12 for clearing obstacles and mines. A common detonating cord can extend through bores in all explosive charges 12 to detonate them virtually simultaneously when detonation cord is initiated, and an obstacle-free lane is cleared across an area. Only a few explosive charges 12 are shown in the drawings for the purposes of demonstrating this inventive concept. It is to be understood that many explosive charges 12 could be included in line charge 10, or several sections of such line charges could be coupled together when more explosives are needed to accomplish the mission. Details of line charge 10 and the associated constituents are explained in greater detail in the above referenced copending applications. Furthermore, other types of ordnance than those described herein could be safely and reliably used when they are appropriately coupled to fuze 50. One example is the use of this fuze coupled to diver-emplaced mine neutralization charges. The diver emplaces this fuze and then swims away. Many other applications are possible where command and control functions are desired, including those related to less critical firing device functions like as required for the command detonation of blasting cap detonators.

Since the firing team on LCAC 15 can closely approach the obstacle laden beach, line charge 10 can be accurately aimed and set across the designated area by rocket 11. Tethers and/or drogue chutes, not shown, could be included to assure correct deployment. In addition, other methods for deploying line charge 10 could be used, such as towing, parachute laying, catapulting, and air gunning.

After line charge 10 rests across the designated area, fuze 50 responds to various commands transmitted by magneto-inductive command signals in the ELF to VLF range to ultimately detonate line charge 10. These magneto-inductive command signals in the ELF to VLF range are transmitted from antenna 25 extending from magneto-inductive transmitter/reciever 20 on LCAC 15 located at a safe distance from the charge 10. Transmitter/reciever 20 also may be placed on other craft, such as helicopters, surface craft, etc. to function as the command source for the commands, although the commands might originate at other remote stations. Magneto-inductive status signals 50' in the ELF to VLF range that are transmitted from fuze 50 to confirm its status to LCAC 15 or other remote stations are received by antenna 25 and fed to transmitter/reciever 20 for observation and/or further action. Antenna 25 is on LCAC 15 above the water; however, antenna 25 could extend far above LCAC 15, or hang below or behind it in the water and still function to transmit and receive magneto-inductive signals in the ELF to VLF range.

Magneto-inductive communication with magneto-inductive signals uses the quasi-static AC magnetic field generated by a transmitting antenna operated with very low radiation impedance. Using magneto-inductive ELF to VLF communications in the 1–4000 Hz range assures transmission of command and status signals reliably through ground, water, and air, and permits transmissions to other stations. This allows selective monitoring and command by other friendly command sources if LCAC 15 is disabled after launch of line charge 10, for example.

Figure 2:
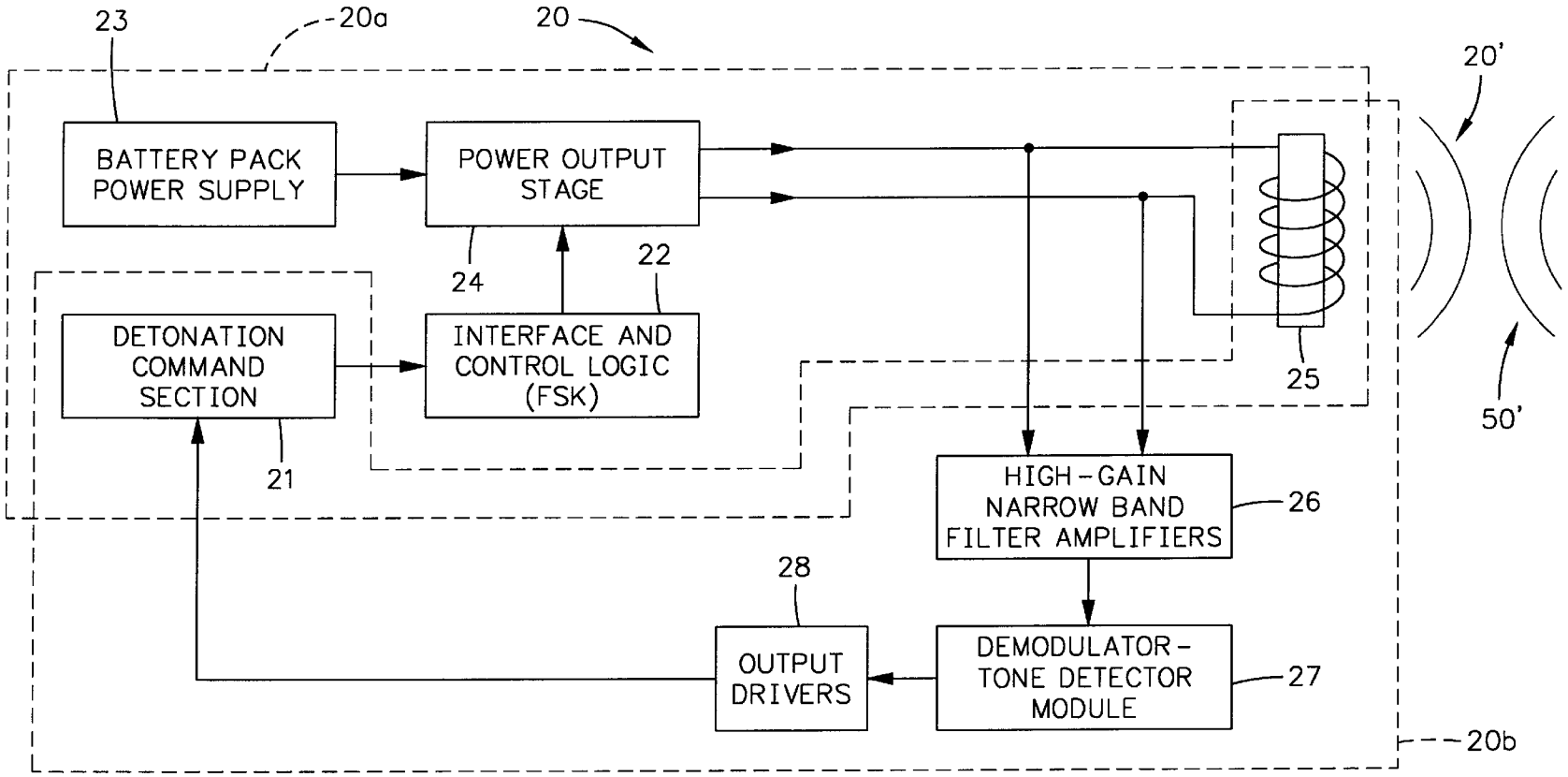
FIG. 2 schematically shows details of the transmitter/receiver of a remote station.
Figure 2A:
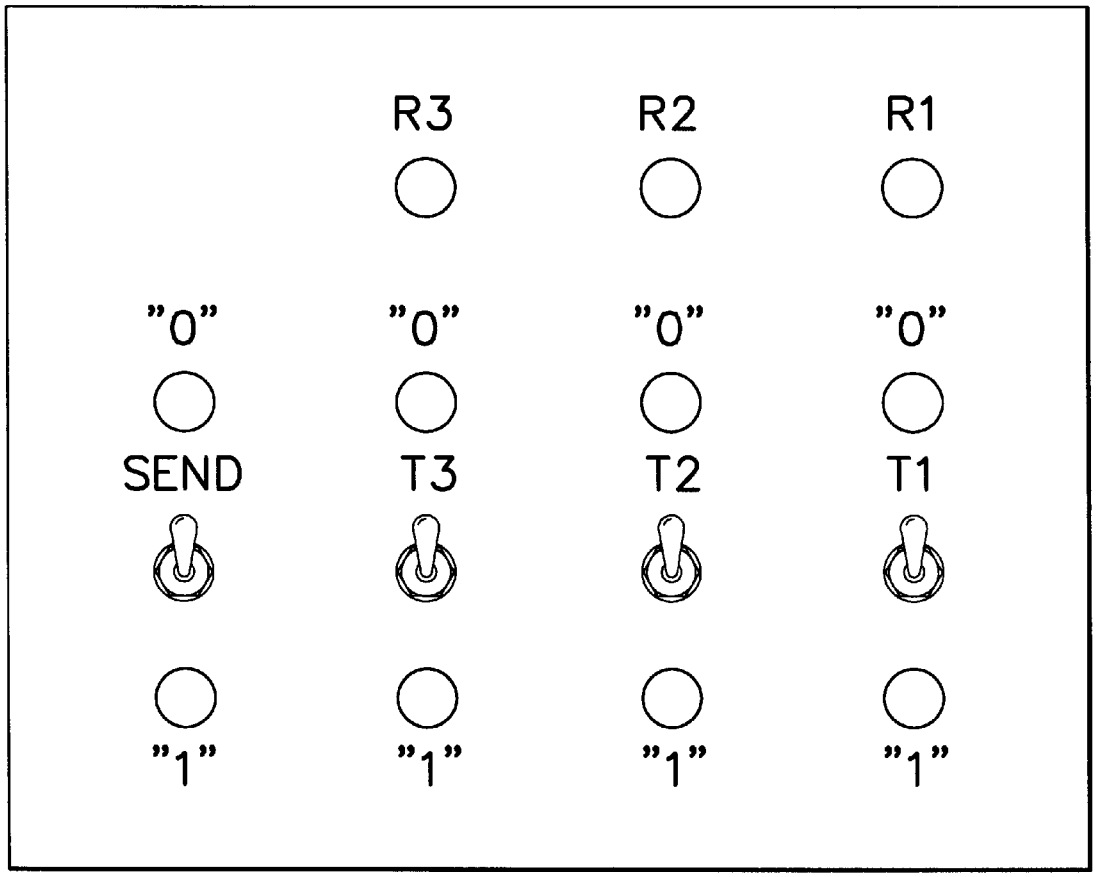
FIG. 2*a* depicts an exemplary control panel for detonation command section.

Referring to FIGS. 2 and 2*a*, magneto-inductive transmitter/reciever 20 has a transmitter section 20*a* and receiver section 20*b* which share some components between them. Transmitter section 20*a* includes detonation command section 21 which may have a switch and display panel and/or a laptop computer, interface and control logic module 22, battery pack power supply 23, transmitter power output stage 24, and magneto-inductive transmitter antenna 25. Detonation command section 21 has a number of switches and interconnected LEDs. When certain ones of these switches are selected and appropriately actuated, LEDs on the top and the bottom of the switches light up to indicate that the designated command is ready to be transmitted to fuze 50.

The output of detonation command section 21 is connected to interface and control logic module 22. When the operator presses the send button on the display panel or presses a predefined key on the laptop keyboard of detonation command section 21, module 22 receives the command (s) and encodes the command to a series of predetermined tones (or bits). Next, control logic module 22 modulates these tones (or bits) using audio frequency shift keying (AFSK) to modulate a carrier frequency in the ELF to VLF range. Any of several different carrier frequencies within the ELF to VLF range could be used to responsively control fuze 50. Furthermore, a number of additional fuzes 50, not shown, could be armed and fired by command signals within the same time frame on different frequencies in the ELF and VLF range. In addition, one frequency could be used to control the status of several fuzes, including firing, virtually simultaneously.

Power supply 23 can be any suitable available power supply, such as rechargeable batteries to drive power output stage 24. Power supply 23 also is coupled to power other parts of transmitter/reciever 20; however, these connections are not shown to avoid needless cluttering of the drawings. Power output stage 24 may be power MOSFET drivers for driving antenna 25.

The same antenna can be used as a transmitter antenna and a receiver antenna. Accordingly, antennas 25 and 55 for magneto-inductive signals in the ELF to VLF range are either air-cored or may employ steel or ferrite for field enhancement during transmission and reception. As a consequence, bidirectional communications between transmitter/reciever 20 and fuze 50 rely on antenna 25 to transmit magneto-inductive command signals 20' in the ELF to VLF range and to receive magneto-inductive status signals 50' in the ELF to VLF range. Further bidirectional communications between fuze 50 and transmitter/reciever 20 use antenna 55 for fuze 50 to receive magneto-inductive command signals 20' and to transmit magneto-inductive status signals 50'.

Magneto-inductive signal transmitter/reciever 20 is located on LCAC 15 or another surface vessel, remotely operated vehicle, aircraft or a land-based station. When an exemplary control panel is used in detonation command section 21, it consists of n+1 switches which represents "n" commands and one "send," switch or transmit command. Each switch setup represents a discreet and distinguishable command signal for each of the "n" commands. Each command signal is a series of tones or bits generated by modulation of a carrier frequency. The number of commands can be easily increased by increasing the number of tones or bits, such as T1, T2, and T3, and by determining what the tones are, the command is identifiable. Adding more tones or bits than T1, T2, and T3, could make this highly secure communication channel more secure and flexible by further encryption of the communications or provide/exchange field strength information as a means to measure separation distance from LCAC 15 nc fuze 50. Typically, these tones T1, T2, and T3 could be exemplary commands to change the status of fuze 50 such as in the following table:

| Tones or Bits | | | |
|---|---|---|---|
| T3 | T2 | T1 | Commands |
| 0 | 0 | 0 | IDEAL |
| 0 | 0 | 1 | ON |
| 0 | 1 | 0 | OFF |
| 0 | 1 | 1 | ARM |
| 1 | 0 | 0 | DISARM |

-continued

| Tones or Bits | | | |
|---|---|---|---|
| T3 | T2 | T1 | Commands |
| 1 | 0 | 1 | FIRE |
| 1 | 1 | 0 | SELF-STERILIZE |
| 1 | 1 | 1 | STATUS REQUEST |

To transmit a command signal, the operator on LCAC 15 sets the switches of the panel to an appropriate position or presses a preprogrammed key on the laptop in detonation command section 21 to generate preselected tones or combinations of tones or bits T1, T2, and T3 and to process them by section 21 and interface and control logic module 22. Discreet and distinguishable combinations of T1, T2, and T3 represent distinct command signals 20' for fuze 50. Pressing the send button transmits the designated command signal as magneto-inductive command signals 20' from antenna 25.

When fuze 50 receives command signals 20' on antenna 55, it appropriately responds to perform that command. Receiver portion 50*a* of fuze 50 receives magneto-inductive command signals 20' on antenna 55 and effects the indicated action. Fuze 50 also transmits magneto-inductive status signals 50' in the ELF to VLF range from antenna 55 to indicate that fuze 50 has, in fact, received command signals 20' and initiated appropriate action.

Transmitter/reciever 20 on LCAC 15 has receiver section 20*b* to receive magneto-inductive status signals 50' in the ELF to VLF range from fuze 50. Receiver section 20*b* receives magneto-inductive status signals 50' on the same antenna 25 as transmitter section 20*a* transmits magneto-inductive command signals 20'. The received status signals 50' are coupled to two high gain narrow band filter amplifiers 26 serially connected in a single superheterodyne configuration in order to minimize the internal noise of the circuit and maintain a very high gain. The output from amplifiers 26 is connected to demodulator-tone detector module 27. Module 27 may include an amplitude modulation (AM) demodulator to detect the smallest amplitude modulation of the carrier frequency and narrow band, phase locked loop (PLL) based tone decoders which determine the desired tones. The PLL converts the tone bursts into the corresponding voltage levels necessary to reconstruct the transmitted tones or digital data of status signals 50' which were sent from fuze 50. The output of the PLL is coupled to output drivers 28 to light up LEDs on the front panel or display information on laptop computer of detonation command section 21 to confirm receipt of command signals 20' by fuze 50 and indicate the status of fuze 50.

Figure 3:
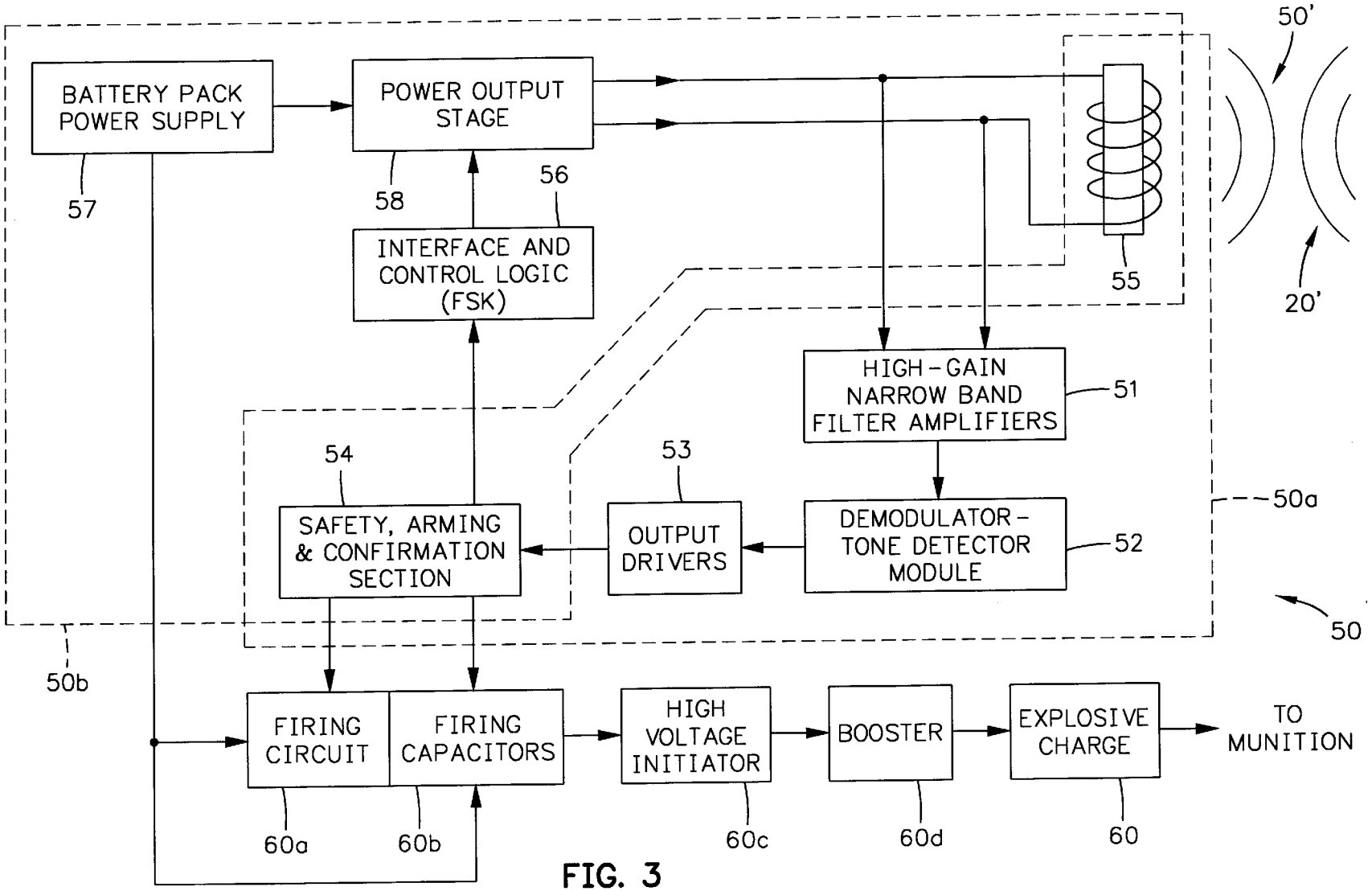
FIG. 3 schematically shows details of the fuze.

Referring to FIG. 3, fuze 50 has receiver portion 50a for receiving magneto-inductive command signals 20' in the ELF to VLF range from transmitter section 20*a* of transmitter/reciever 20 on LCAC 15. Fuze 50 also has transmitter portion 50*b* for sending magneto-inductive status signals 50' in the ELF to VLF range to transmitter/reciever 20 or any number of other receiving stations. Receiver portion 50*a* receives magneto-inductive command signals 20' on the same antenna 55 as transmitter portion 50*b* transmits magneto-inductive status signals 50'. The received command signals 20' are coupled to two high gain narrow band filter amplifets 51 serially connected in a single superheterodyne configuration in order to minimize the internal noise of the circuit and maintain a very high gain. The output from amplifets 51 is connected to demodulator/tone detector module 52. Module 52 may include an amplitude modulation (AM) demodulator to detect the smallest amplitude modulation of the carrier frequency and narrow band phase locked loop (PLL) based tone decoders which determine the desired tones. The PLL converts the tone bursts into the corresponding voltage levels necessary to reconstruct the transmitted tones or digital data of command signals 20'. The output of the PLL is coupled to output drivers 53 to either drive the logic unit of safety, arming and confirming section 54 of fuze 50 or to generate the proper voltages for detonation of explosive charge 60 of fuze 50.

Transmitter portion 50*b* of fuze 50 has interface and control logic module 56, battery power supply 57, status power output stage 58 and antenna 55. Battery power supply 57 drives power output stage 58 which may include power MOSFET drivers to drive antenna 55 and transmit status signals 50' (confirmations). Battery power supply 57 also is coupled to enable the other components of fuze 50 although the interconnections are not shown for the sake of clarity.

When receiver portion 50*a* receives certain command signals 20', safety, arming, and confirmation section 54 produces status signals that both indicate proper reception, or confirmation, of the command signal and the status of fuze 50. The status of fuze 50 is one of the conditions of fuze 50 that have been created in response to command signals and could be one of: IDEAL, ON, OFF, ARM, DISARM, FIRE, SELF-STERILIZE, AND STATUS REQUEST, for example. Section 54 is included as a part of receiver portion 50*a* to change the status of fuze 50 and to provide status signals 50' which confirm the receipt of magneto-inductive command signals 20' on antenna 55 and status of the fuze.

In addition, section 54 is included as part of transmitter portion 50*b* to provide these status signals for interface and control logic module 56. Module 56 receives this signal and encodes it to a predetermined tone or bit and then modulates this tone (or bit) by using the AFSK modulation technique at a carrier frequency of less than 4,000 Hz. A preferred frequency is 3,000 Hz, although other frequencies within the ELF to VLF spectrum may be used. The status, or confirmation signal is transmitted from fuze 50 via magneto-inductive status signals 50' in the ELF to VLF range to any number of stations that are in the area.

Safe, arm, and confirmation section 54 of receiver portion 50*a* also provides logic discrimination to effect the fuze safety functions listed in the table above for fuze 50. For example, to effect safety, section 54 establishes that the sequence "ON-ARM-FIRE" must occur within a prescribed period, and within this period command signals from the remote stations must be in proper sequence. Otherwise, the system reverts to safe "off" or "010" status. Once the "ON-ARM-FIRE" signal sequence is received within the prescribed period, section 54 effects the fire command. Each "ON," "ARM," and "FIRE" command opens an independent circuit switch in section 54. Once all three independent circuits are opened, a signal to bring about the "FIRE" command is fed to firing circuit 60*a*. To assure simultaneous detonation of all deployed fuzes, the "ARM" command charges firing capacitors 60*b* prior to the "FIRE" command signal.

Firing circuit 60*a* has a DC-DC voltage converter to multiply the power of power supply 57 to about 3,000,000 watts. Firing circuit 60*a* also has separate fast switches delivering power from firing capacitors 60*b* to high voltage initiator 60*c*. Initiator 60*c* can be either an exploding foil initiator, e.g., a charge of HNS-type IV explosive, or a laser transferring high power directly into photons which functions to transfer energy into HNS-type IV explosive. Initiation of the HNS-type IV explosive detonates a booster charge 60*d* and subsequently detonates main charge 60 such as, the detonation cord that extends through line charge 10. Initiator 60*c* needs about 0.23 Joules, with a threshold voltage of approximately 1350 volts using a 0.25 micro farad capacitor in a circuit having no more than 25 nanohenries of inductance. To achieve reliable function, a spark gap switch or faster device is used in an appropriate spark gap trigger circuit. Although the firing circuit described herein provides outstanding safety, if a lower cost alternative is desired, Exploding Bridge Wire (EBW) detonation or M6 Electric Blasting Caps can be used. This results in lower power requirements.

The sterilization feature of section 54 may operate to prevent any signal from activating initiator 60*c*. The sterilization feature of section 54 may also inhibit initiator 60*c* when too long of an interval has lapsed, i.e., the "ON-ARM-FIRE" window of time has been exceeded. The connections between each of the modules uses diodes or similar current controlling components to eliminate any possibility of sneak circuitry reverse current flow that could result in a safety failure.

When the "ON-ARM-FIRE" command signal sequence from transmitter/reciever 20 is received within the prescribed window of time, logic in section 54 brings about the detonation of explosive charge 60. Each "ON," "ARM," and "FIRE" command signal from transmitter/reciever 20 causes logic in section 54 to open three independent switches in firing circuit 60*a*. The ON command signal from transmitter/reciever 20 causes logic in section 54 to open at least one independent switch in firing circuit 60*a* to couple it to power supply 57. The ARM signal from transmitter/reciever 20 opens at least one independent switch in firing circuit 60*a* to charge all firing capacitors 60*b* prior to receiving the FIRE command signal from transmitter/reciever 20. The FIRE command signal opens the associated independent switch in firing circuit 60*a* to discharge capacitors 60*b* to initiator 60*c* to initiate initiator 60*c* and explosive charge 60 which detonates line charge 10. Thus, detonation occurs when all three independent and isolated switches are opened and the composite signal transfers the FIRE command from firing circuit 60*a*.

Fuze 50 and the system in which it operates have numerous advantages over the prior art. Fuze 50 safely and reliably communicates and controls with confirmation via status signals, to remote stations without communications cables. Fuze 50 reliably communicates command signals to it and status signals from it using magneto-inductive signals in the ELF to VLF range. Fuze 50 assures communications to and from it when it is in water, mud, sand, earth, vegetation and debris without a floating antenna. Fuze 50 assures communications to and from it when it is placed in multi-conductive paths (i.e., air/seawater interfaces) in very high acoustic ambient noise. Fuze 50 is capable of reporting its fuzing status/confirmation to the LCAC platform, or other friendly platforms in the area of operations. Fuze 50 can be used in all sea states, tides and surf conditions; in the water regardless of salinity, thermal anomalies, and clarity; and under all weather conditions day and night. Fuzz 50 can be scaled up/down to include more/less bits/tones to cover more/less complex fuze functions or priority tasks of deployed ordnances. Fuze 50 provides for increases in data/code transfer by repetitively using a bit word to generate additional codes.

Fuze 50 can be used on any munition that can be command controlled from a surface, subsurface, or airborne craft within an operational theater. Fuze 50 can detonate general purpose bombs, initiate explosive detonating cord arrays, activate flares, etc. Fuze 50 without exploding foil initiator 60*a* or high energy laser initiator 60*b* can be used as a general purpose remote control firing device mechanism to detonate blasting caps or EBWs, activate sonobuoys, deploy floating buoys, sink buoys, deploy markers, operate electric devices etc. Fuze 50 can be built for long distance operation using higher levels of power for transmission and/or a larger antenna. As a general purpose remote control device, fuze 50 and the system in which it operates provide reliability and safety comparable to mission critical and man-rated devices.

The disclosed components and operation as disclosed herein all contribute to the novel features of this invention. These novel features assure safety and more reliable detonation of remote ordnance by fuze 50 and its associated system to successfully complete the mission. The components of the fuze 50 and transmitter/reciever 20 are capable of being tailored for a wide variety of different tasks, yet such modifications are within the scope of this invention. For example, different ordnance packages, different combinations of frequencies in the ELF to VLF range, and/or different modulation techniques than as shown herein could be chosen to meet specific electromagnetic requirements without departing from the scope of this invention.

Furthermore, having this disclosure in mind, one skilled in the art to which this invention pertains will select and assemble suitable components for fuze 50 and transmitter/reciever 20 from among a wide variety available in the art and appropriately interconnect them to satisfactorily function as disclosed. Thus, the disclosed arrangement is not to be construed as limiting, but, rather, is intended to demonstrate this inventive concept.

It should be readily understood that many modifications and variations of the present invention are possible within the purview of the claimed invention, including those related to simpler firing devices used to detonate EBWs and blasting caps. It is to be understood that within the scope of the appended claims the invention may be practiced otherwise than as specifically described.

We claim:

1. A fuze for ordnance responsive to magneto-inductive command signals in the ELF to VLF range from a remote station to change its status and to transmit magneto-inductive status signals in the ELF to VLF range to said remote station confirming said status, said command and status signals being transmitted in said ELF to VLF range to assure transmission reliably through ground, water, and air, said fuze having a receiver portion coupled to an antenna to receive said magneto-inductive command signals and a transmitter portion coupled to said antenna to transmit said magneto-inductive status signals and said receiver portion having high gain narrow band filter amplifiers receiving said magneto-inductive command signals, a demodulator-tone detector module coupled to said high gain narrow band filter amplifiers, output drivers coupled to said demodulator-tone detector module, and a safety, arming, and confirmation section.

2. A fuze according to claim 1 in which said high gain narrow band filter amplifiers are connected as a single superheterodyne to minimize internal noise and maintain very high gain, said demodulator-tone detector module detects the amplitude modulation of a carrier frequency of said magneto-inductive command signals and determines encoded tones, and said safety, arming and confirmation section changes the status of said fuze and provides status signals confirming receipt of said magneto-inductive command signals and status of said fuze.

3. A fuze according to claim 2 in which said transmitter portion includes said safety, arming and confirmation section, an interface and control logic module connected to said safety, arming and confirmation section, and a power output stage.

4. A fuze according to claim 3 in which said safety, arming and confirmation section provides said status signals, said interface and control logic module encodes said status signals with predetermined tones and modulates said predetermined tones by audio frequency shift keying a carrier frequency in the ELF to VLF range, and said power output stage transmits said magneto-inductive status signals from said antenna.

5. A fuze system for ordnance comprising:

a transmitter-receiver at a remote station to transmit magneto-inductive command signals in the ELF to VLF range and a fuze coupled to ordnance, said fuze being responsive to said magneto-inductive command signals in the ELF to VLF range to change its status and to transmit magneto-inductive status signals in the ELF to VLF range to said transmitter-receiver at said remote station to confirm said status, said command and status signals being transmitted in said ELF to VLF range to assure transmission reliably through ground, water, and air said transmitter-receiver having a transmitter section coupled to a first antenna to transmit said magneto-inductive command signals and a receiver section coupled to said first antenna to receive said magneto-inductive status signals, and said fuze having a receiver portion coupled to a second antenna to receive said magneto-inductive command signals and a transmitter portion coupled to said second antenna to transmit said magneto-inductive status signals.

6. A fuze system according to claim 5 in which said transmitter section has a detonation command section, an interface and control logic module coupled to said detonation command section, and a transmitter power output stage connected to said interface and control logic module.

7. A fuze system according to claim 6 in which said detonation command section designates a command, said interface and control logic module encodes the designated command as predetermined tones and modulates these tones by audio frequency shift keying at a carrier frequency in the ELF to VLF range, and said transmitter power output stage transmits said magneto-inductive command signals via said first antenna.

8. A fuze system according to claim 7 in which said receiver section includes high gain narrow band filter amplifiers, a demodulator-tone detector module coupled to said high gain narrow band filter amplifiers, and output drivers coupled to said demodulator-tone detector module and said detonation command section.

9. A fuze system according to claim 8 in which said high gain narrow band filter amplifiers are connected as a single superheterodyne to minimize internal noise and maintain very high gain, said demodulator-tone detector module detects the amplitude modulation of said carrier frequency and determines said predetermined tones, and said output drivers are coupled to said demodulator-tone detector module and said detonation command section to display status of said fuze in said detonation command section.

10. A fuze system according to claim 9 in which said receiver portion includes high gain narrow band filter amplifiers, a demodulator-tone detector module coupled to said high gain narrow band filter amplifiers, receiver output drivers coupled to said demodulator-tone detector module and a safety, arming and confirmation section connected to said receiver output drivers.

11. A fuze system according to claim 10 in which said high gain narrow band filter amplifiers of said receiver portion receive said magneto-inductive command signals and are connected as a single superheterodyne to minimize internal noise and maintain very high gain, said demodulator-tone detector module detects amplitude modulation of a carrier frequency of said magneto-inductive command signals and determines encoded tones, and said safety, arming and confirmation section changes the status of said fuze and provides status signals confirming the receipt of said magneto-inductive command signals and status of said fuze.

12. A fuze system according to claim 11 in which said transmitter portion includes said safety, arming and confirmation section, an interface and control logic module connected to said safety, arming, and confirmation section, and a status power output stage coupled to said interface and control logic module.

13. A fuze system according to claim 12 in which said safety, arming and confirmation section provides said status signals, said interface and control logic module encodes said status signals with predetermined tones and modulates said predetermined tones by audio frequency shift keying at a carrier frequency in the ELF to VLF range, and said status power output stage transmits said magneto-inductive status signals via said second antenna.

14. A fuze system for ordnance comprising:

means for transmitting magneto-inductive command signals in the ELF to VLF range from a remote station;

means coupled to ordnance for changing its status in response to said magneto-inductive command signals in the ELF to VLF range and for transmitting magneto-inductive status signals in the ELF to VLF range to said transmitting means at said remote location to confirm said status, said command and status signals being transmitted in said ELF to VLF range to assure transmission reliably through ground, water, and air;

a first antenna coupled to said transmitting means; and a second antenna coupled to said changing and transmitting means.

15. A fuze system according to claim 14 in which said transmitting means has a transmitter section coupled to said first antenna to transmit said magneto-inductive command signals and a receiver section coupled to said first antenna to receive said magneto-inductive status signals, and said changing and transmitting means has a receiver portion coupled to said second antenna to receive said magneto-inductive command signals and a transmitter portion coupled to said second antenna to transmit said magneto-inductive status signals.

* * * * *